US009182119B2

(12) United States Patent
Mach

(10) Patent No.: US 9,182,119 B2
(45) Date of Patent: Nov. 10, 2015

(54) RADIANT BURNER

(75) Inventor: Alexander Mach, Markkleeberg (DE)

(73) Assignee: Sandvik Intellectual Property AB, Sandviken (SE)

( * ) Notice: Subject to any disclaimer, the term of this patent is extended or adjusted under 35 U.S.C. 154(b) by 934 days.

(21) Appl. No.: 13/390,845

(22) PCT Filed: Aug. 6, 2010

(86) PCT No.: PCT/EP2010/061521

§ 371 (c)(1), (2), (4) Date: Mar. 7, 2012

(87) PCT Pub. No.: WO2011/020723

PCT Pub. Date: Feb. 24, 2011

(65) Prior Publication Data

US 2012/0164590 A1 Jun. 28, 2012

(30) Foreign Application Priority Data

Aug. 18, 2009 (DE) ..... 10 2009 028 624

(51) Int. Cl.
*F23D 14/14* (2006.01)
*F23D 14/58* (2006.01)
*F23D 14/82* (2006.01)

(52) U.S. Cl.
CPC ..... *F23D 14/145* (2013.01); *F23D 14/58* (2013.01); *F23D 14/82* (2013.01); *F23D 2203/1023* (2013.01); *F23D 2212/10* (2013.01); *F23D 2212/20* (2013.01); *F23D 2900/00003* (2013.01)

(58) Field of Classification Search
CPC ..... F23D 14/14; F23D 14/145; F23D 14/58
USPC ..... 431/328, 329, 100, 7; 136/253
See application file for complete search history.

(56) References Cited

U.S. PATENT DOCUMENTS 3,695,818 A * 10/1972 Mizutani ..... 431/328
3,847,534 A 11/1974 Nomaguchi et al.

(Continued)

FOREIGN PATENT DOCUMENTS

CN 101004264 7/2007
CN 101307899 11/2008

(Continued)

OTHER PUBLICATIONS

JP14-6481 by Mitstomo Fukushima of May 8, 1939.*

(Continued)

*Primary Examiner* — Gregory Huson
*Assistant Examiner* — Nikhil Mashruwala
(74) *Attorney, Agent, or Firm* — Morgan, Lewis & Bockius LLP

(57) ABSTRACT

The invention relates to a burner, in particular a radiant burner, for the combustion of a gas mixture of fuel gas and an oxygen carrier gas, with a burner plate with passage channels for the throughflow of the gas mixture from a mixing chamber side to a combustion side, wherein, on the combustion side, combustion channels with an enlarged cross-section compared with the passage channels connect to the passage channels, wherein flow obstacles for a contact with the combustion flame are arranged in the combustion channels and the flow obstacles are made of a material which has a higher thermal conductivity than the material of the burner plate.

11 Claims, 3 Drawing Sheets

(56) References Cited

U.S. PATENT DOCUMENTS

| | | | | |
|---|---|---|---|---|
| 4,673,349 | A * | 6/1987 | Abe et al. | 431/328 |
| 4,919,609 | A | 4/1990 | Sarkisian et al. | |
| 5,026,273 | A * | 6/1991 | Cornelison | 431/170 |
| 5,137,583 | A * | 8/1992 | Parent et al. | 136/253 |
| 5,224,856 | A * | 7/1993 | Nakamura | 431/328 |
| 5,360,490 | A | 11/1994 | Nelson | |
| 5,591,025 | A * | 1/1997 | Invernizzi | 431/329 |
| 5,989,013 | A * | 11/1999 | Gray | 431/326 |
| 7,611,351 | B2 * | 11/2009 | Krauklis et al. | 431/328 |
| 7,717,704 | B2 * | 5/2010 | Burtea et al. | 431/326 |
| 2006/0040224 | A1 | 2/2006 | Lovato et al. | |
| 2013/0273485 | A1 * | 10/2013 | Lenoir et al. | 431/329 |
| 2014/0248570 | A1 * | 9/2014 | Zhang et al. | 431/263 |

FOREIGN PATENT DOCUMENTS

| | | | |
|---|---|---|---|
| DE | 2244 508 | | 9/1972 |
| DE | 693 22 622 | | 5/1999 |
| DE | 198 47 042 | | 4/2000 |
| DE | 100 28 670 | | 12/2001 |
| DE | 100 38 716 | | 2/2002 |
| EP | 0 580 500 | | 1/1994 |
| EP | 1 544 542 | | 6/2005 |
| JP | 14-006481 | Y | 1/1939 |
| JP | 14-6481 | | 5/1939 |
| JP | 50-30336 | U | 4/1975 |
| JP | 58-120577 | | 7/1983 |
| JP | 61-79726 | U | 5/1986 |
| JP | 63-217121 | | 12/1987 |
| JP | 63-30721 | | 2/1988 |
| JP | 05-157214 | | 6/1993 |
| JP | 52-018236 | | 2/1997 |
| JP | 9-112842 | | 5/1997 |
| WO | 93/18342 | | 9/1993 |

OTHER PUBLICATIONS

JP50-30336 B2 of Apr. 1975 , other details NLA.*

Office Action (with English translation) for Chinese Patent Application No. 2010-80036585.2, dated Dec. 3, 2013.

Office Action (with English translation) for Japanese Patent Application No. 2012-525121, dated Oct. 22, 2013.

German Search Report for Application No. 10 2009 028 624.1 dated Aug. 18, 2009.

International Search Report for PCT/EP2010/061521 dated Feb. 17, 2012.

International Preliminary Report on Patentability for PCT/EP2010/061521 dated Mar. 20, 2012.

* cited by examiner

RADIANT BURNER

RELATED APPLICATIONS

The present application is a U.S. National Phase Application of International Application No. PCT/EP2010/061521 (filed 6 Aug. 2010) which claims priority to German Application No. 10 2009 028 624.1 (filed 18 Aug. 2009).

SUBJECT OF THE INVENTION

The invention relates to burners, in particular a radiant burner, for the combustion of a gas mixture of fuel gas and an oxygen carrier gas. The burner has a burner plate with passage channels for the throughflow of the gas mixture from a mixing chamber side to a combustion side. On the combustion side, combustion channels with an enlarged cross-section compared with the passage channels connect to the passage channels.

BACKGROUND OF THE INVENTION

Radiant burners or surface burners of the type according to the preamble have a mixing chamber in which a gas mixture of fuel gas and an oxygen carrier gas is produced. Connected to the mixing chamber is a burner plate with passage channels through which the gas mixture flows out of the mixing chamber and is burned.

The passage channels in the burner plate for the throughflow of the gas mixture from the mixing chamber side to a combustion side are so narrow that the individual flames forming on the exit side cannot flash back into the mixing chamber. A flash-back of the flames through the passage channels into the mixing chamber is prevented if the diameter of at least sections of the passage channels is smaller than the so-called extinction distance (or also quenching distance) of the combustion. The quenching distance is the distance from the fuel gas outlet within which no reactions take place and a flame cannot spread as the released combustion enthalpy is absorbed by the surrounding burner material and conducted away and the reaction chains are terminated. However, the quenching distance is not an absolute value but depends i.a. on the composition of the fuel gas, the fuel-gas temperature and the wall temperature.

With a radiant burner, the thermal output produced by the combustion is to be distributed evenly over a large area. For this, the material of the burner or burner plate is heated by the flames of the gas combustion until it glows and delivers an effective heat radiation to the material to be heated. If the flames burn as individual flames over the burner plate, the material is heated only weakly and inefficiently. To achieve an effective heating of the burner material, the flame is to burn as close as possible to and in close contact with the material. For this, the flame is preferably moved into the burner plate either by designing the latter porous and producing a blanket of flames in the porous material or by allowing the combustion to proceed in channels (combustion channels) inside the burner plate.

For example, a burner plate for a surface burner is known from DE 100 28 670 in which, on the exit side on the combustion side, channels with an enlarged cross-section compared with the passage channels, in which the combustion takes place, connect to passage channels for the fuel gas the diameter of which is smaller than the quenching distance of the combustion. For this design, the object of the invention in DE 100 28 670 was to produce a burner plate which makes possible a dramatic reduction in specific thermal output in order to use the burner to heat e.g. plastic material indirectly over a large surface area to low temperatures of only 100 to 300° C. For this it is necessary for the average surface temperature of the burner plate to be reduced to well below 900° C. without incomplete combustion resulting or the flame going out.

In the case of a high fuel gas throughflow to produce a high heat flux density, the individual flames burn on the exit side surface of the burner plate. When the heat flux density is reduced, they retreat progressively and pass into the combustion channels as their diameter is larger than the quenching distance of the combustion. In the case of a very low heat flux density, the flames remain at the transition zone between the passage channels and the enlarged cross-sections as the diameter of the passage channels is smaller than the quenching distance of the combustion. The specific thermal output of the burner according to DE 100 28 670 can thereby be very greatly reduced.

The described design has the disadvantage that, if a high fuel gas throughflow for a high radiant power and burner temperature is desired, the flames emerge from the combustion channels at the surface of the burner plate, whereby the radiant power falls and the flame is unprotected against flows and turbulences, which can result in the flame going out.

OBJECT OF THE INVENTION

The object of the present invention was to provide a radiant burner and a burner plate for a radiant burner with which the known disadvantages of the state of the art are overcome and with which a high energy efficiency, a high radiant power and a high flame stability are achieved.

DESCRIPTION OF THE INVENTION

The object according to the invention is achieved by a burner, in particular a radiant burner, for the combustion of a gas mixture of fuel gas and an oxygen carrier gas, with a burner plate with passage channels for the throughflow of the gas mixture from a mixing chamber side to a combustion side, wherein, on the combustion side, combustion channels with an enlarged cross-section compared with the passage channels connect to the passage channels and flow obstacles are arranged in the combustion channels for a contact with the combustion flame, wherein the flow obstacles are made of a material which has a higher thermal conductivity than the material of the burner plate.

In one embodiment of the burner according to the invention, the passage channels for the throughflow of the gas mixture have at least one point over their length a maximum diameter which is smaller than the quenching distance of the combustion.

The term "maximum diameter" within the meaning of the present invention denotes the longest possible connection inside the passage channel transverse to its longitudinal axis or longitudinal extension. In the case of a passage channel with a circular cross-section, the diameter is always equal to the circle diameter. In the case of a square or rectangular cross-section, on the other hand, the "maximum diameter" is the diagonal connection between two opposite corners of the square or rectangle, whereas the minimum diameter of a passage channel with a square cross-section would be the distance between two opposite sides. In the case of a rectangular cross-section, the minimum diameter of the passage channel would be the distance between the two longer opposite sides of the rectangle.

The passage channels for the throughflow of the gas mixture preferably have substantially over their whole length a uniform maximum diameter which is smaller than the quenching distance of the combustion. The passage channels particularly preferably have an oval or circular cross-section. In other words, in the case of this embodiment the maximum diameter remains the same over the whole length of the channel and does not change. The passage channel preferably also has the same cross-section, e.g. circular, oval, square, rectangular etc., over its whole length.

As a result of the above-named measure that the maximum diameter of at least sections of the passage channels is smaller than the quenching distance of the combustion, a flash-back of the flames through the passage channels into the mixing chamber is impeded. As the same gas mixture composition and known materials are as a rule used for specific burner applications, and the combustion temperature and wall temperature to be achieved are known, a person skilled in the art can easily determine the minimum quenching distance and calculate the diameter of the passage channels accordingly.

In a further embodiment of the burner according to the invention, at least sections of the combustion channels have over their length a maximum diameter which is greater than the quenching distance of the combustion.

The combustion channels preferably have over their whole length a uniform diameter which is greater than the quenching distance of the combustion. The combustion channels particularly preferably have an oval or circular cross-section.

Because the diameter of at least sections of the combustion channels is greater than the quenching distance of the combustion, the flames can pass into the combustion channels and the combustion can take place in the combustion channels.

A closer contact of the flames with the burner material and an effective heating of the burner material are thereby achieved. The thermal output produced by the combustion is distributed uniformly over the surface of the burner plate, and the material of the burner or of the burner plate delivers an effective heat radiation onto the material to be heated. As a result of the burning of the flames in the combustion channels, they are protected against flows and turbulences and against extinguishing. Thus a high energy efficiency, a high radiant power and a high flame stability is achieved.

In a further embodiment of the burner according to the invention, the cross-section at the transition zone between the passage channels and the combustion channels widens conically, stepwise or in a combination of both.

A cross-section that widens stepwise at the transition zone between the passage channels and the combustion channels is achieved in one embodiment of the invention by having the burner plate composed of at least two single plates, arranged one above the other, which have at points one above the other channel bores which have a smaller diameter or cross-section according to the invention in the single plate with the passage channels than in the single plate with the combustion channels.

According to the invention, flow obstacles for a contact with the combustion flame are arranged in the combustion channels, wherein the flow obstacles are made of a material which has a higher thermal conductivity than the material of the burner plate. The flow obstacles are arranged such that the combustion flame touches the flow obstacles. The flow obstacles ensure that the flame is stabilized, in particular in the case of a high fuel gas throughflow to produce a high heat flux density. In addition, the flow obstacles ensure that the flame passes as little as possible out of the combustion channels, thereby improving the heating output. The flame is protected in the channel against flows and gases which could cause it to be extinguished. The flame heights are low, with the result that a material to be heated can be positioned closer to the radiant burner or passed closer by it. If the burner output is small, the flame can heat the flow obstacle in the combustion channel, which can thus serve as ignition source.

The flow obstacles in the burner plate of the burner according to the invention make a substantial contribution to the much faster stabilization of the burner flames and their faster passage into the combustion channels when the burner is ignited than without the flow obstacles. They also ensure that the material of the burner plate is heated faster than without the flow obstacles.

Radiant burners of the type according to the invention have a lower output limit that is very low. At the same time, an increased rate of combustion in porous media or channelled media leads to a high maximum output, with the result that a further output range can be covered with such burners. A further result of the increased rate of combustion is that with such a burner surface loads of up to 4 $MW/m^2$ can be achieved for natural gas/air mixtures. Consequently, these burners can be designed much more compact than other burners of comparable output. In addition, a much higher proportion of the heat is output via radiation from the combustion zone than in the case of open flames where most of the heat remains in the exhaust gas. Regarding the burn-out distance, these burners have advantages compared with burners with open flames as the combustion takes place predominantly or completely within the matrix over the whole output range. This is also favourable when integrating heat exchangers. As a result of the high surface loads of such burners in conjunction with a short burn-out distance, substantially more compact heating devices can be designed as large-capacity combustion chambers and large convection surfaces can be dispensed with.

As a result of the increased heat transport within the burner material, a homogeneous temperature field can thus be set, with the result that both the $NO_x$ emissions and the CO emissions are very low. Furthermore, in burners of the type according to the invention and in porous burners the limit at which either a blow-out or the extinguishing of the reaction can occur is much lower than with comparable open-flame burners.

With the proposed burner design according to the invention, burner properties comparable to those of known porous burners can be achieved.

In a further embodiment of the burner according to the invention, the flow obstacles are made of metal or ceramic. Flow obstacles made of metal have a very good thermal conductivity and thus promote in particular the flame stabilization through the flow obstacles. Suitable metals for producing flow obstacles according to the invention are for example steels with the material numbers 1.4841, 1.4765, 1.4767, 2.4869 and 2.4867 (material numbers according to EN 10027-2). Suitable ceramic materials for producing flow obstacles according to the invention are for example SiC or SiSiC.

In a further embodiment of the burner according to the invention, the flow obstacles are formed as rods with round or polygonal cross-section or as a metal strip or as a perforated plate.

Flow obstacles formed as rods preferably extend transversely through the combustion channels.

In an embodiment of the invention that is particularly advantageous to produce, the flow obstacles are formed as rods or wires extending transversely through the combustion channels, wherein in each case a rod or wire extends through the combustion channels arranged adjacently in a row over the width of the burner plate or transversely through the burner plate.

As was already stated above, in the case of one embodiment of the burner according to the invention the burner plate is constructed from at least two single plates arranged one above the other, wherein a first single plate, which is arranged towards the mixing chamber side during operation, has the passage channels, and a second plate, which is arranged towards the combustion side during operation, has the combustion channels. With this design, the first plate, which is arranged towards the mixing chamber side during operation, preferably has a lower heat capacity and/or a lower thermal conductivity than the second plate, which is arranged towards the combustion side during operation.

In a further preferred embodiment of the burner according to the invention, the burner plate is made of high-temperature-resistant ceramic fibrous material with low thermal conductivity.

The ceramic fibrous material of which the burner plate is made preferably contains 40 to 90 wt.-% $Al_2O_3$ and 10 to 60 wt.-% $SiO_2$ or 60 to 85 wt.-% $SiO_2$ and 15 to 25 wt.-% (CaO+MgO).

Suitable fibrous materials are commercially available from Sandvik Materials Technology Deutschland GmbH, Mörfelden-Walldorf, Germany, under the name FIBROTHAL (F-17/LS, F-19, F-14).

In one embodiment of the invention, the flow obstacles are designed in the form of a cover plate arranged above the burner plate, wherein the cover plate has, above the outlets of the combustion channels, bores with a cross-section which is smaller than that of the outlets of the combustion channels but larger than the quenching distance of the combustion. Because the bores of the cover plate are narrower than the exit-side ends of the combustion channels of the burner plate, flame shielding is improved.

The passage channels in the burner plate of the burner according to the invention preferably have a diameter of approx. 0.6 to 1.2 mm and a length which corresponds to approximately 4 times to 15 times their diameter.

The enlarged cross-sections are preferably bores with a diameter of approx. 1.5 to 6 mm, wherein the length of the bores corresponds to approximately 1 to 3 times their diameter.

If the burner plate is made of ceramic material, the bores can be pressed in during production of the burner plate. They preferably run perpendicular to the exit-side surface of the burner plate.

The passage channels and the combustion channels in the burner plate are preferably distributed over the burner plate in a regular pattern. The reciprocal distance is chosen such that a certain ignition transfer of the combustion over the surface of the burner plate is ensured. The distance between adjacent passage channels preferably corresponds to approximately 1.5 times to 6 times their diameter. The distances in longitudinal direction of the burner plate can be shorter or longer than the distances in transverse direction. It is also possible to provide the burner plate with areas of different flame density by distributing the passage channels and the combustion channels in the burner plate according to the desired flame density over the burner plate.

Further advantages, features and forms of the present invention are explained below with reference to preferred embodiment examples in connection with the attached figures.

Figure 1:
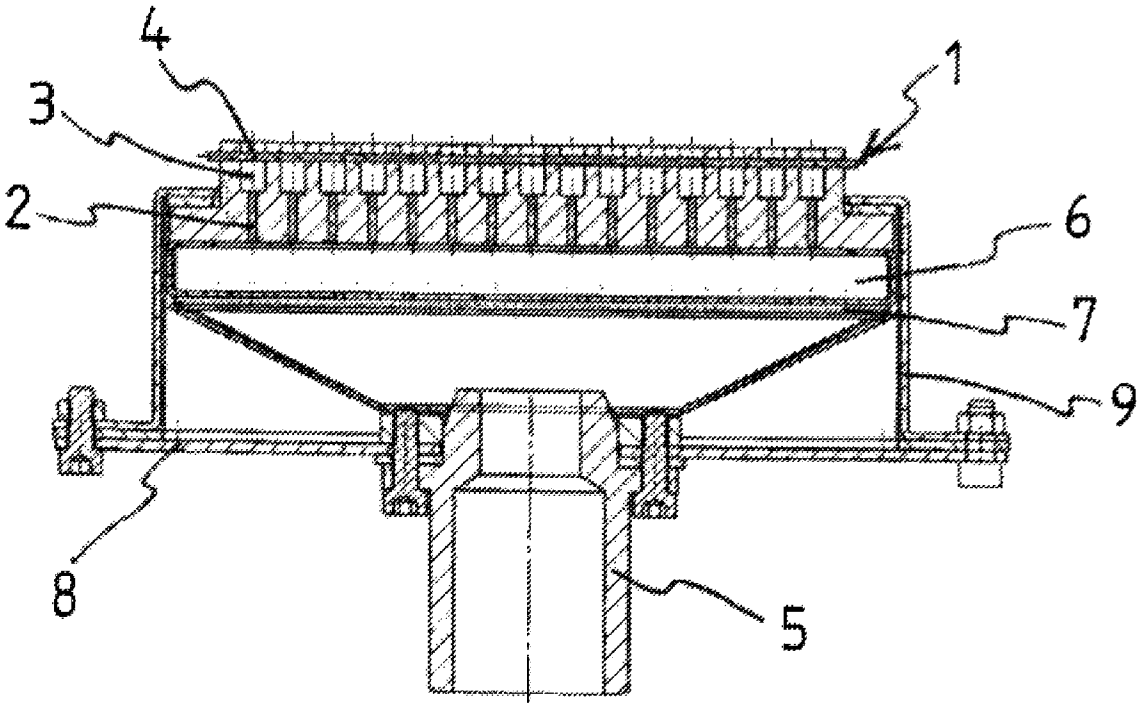
FIG. 1 shows a cross-section through a burner according to the invention with a burner plate.

FIG. 1 shows a cross-section through a burner according to the invention with a burner plate 1 which is mounted on a mounting base plate 8 by means of fixing sheets 9. The burner plate 1 has passage channels 2 and combustion channels 3 connected thereto, wherein the combustion channels 3 have an enlarged cross-section compared with the passage channels 2. Below the burner plate 1 is a mixing chamber 6 into which a fuel gas, preferably a natural gas-air mixture, is introduced through a gas feed line 5. A perforated sheet 7 for a better mixing and distribution of the combustion is gas is provided in the mixing chamber 6. When the burner is operating, the fuel gas flows out of the mixing chamber 6 from the lower end through the passage channels 2 and continues through the combustion channels 3. The passage channels 2 in the burner plate 1 are formed as cylindrical bores with a diameter which is smaller than the quenching distance of the combustion, with the result that the flame cannot flash back from the combustion channels 3 into the passage channels 2. On the other hand, the combustion channels 3 with an enlarged cross-section have a diameter which is greater than the quenching distance of the combustion so that the combustion can take place therein.

A flow obstacle 4 formed as rod (round bar) extends transversely through the combustion channels 3 arranged adjacently in a row. When the fuel gas burns in the combustion channels 3, the flame comes into contact with the flow obstacle 4 and is stabilized thereby. In the embodiment shown here, the burner plate 1 consists of ceramic material of low thermal conductivity, whereas the flow obstacles 4 are made of metal and have a higher thermal conductivity than the material of the burner plate 1.

Figure 2:
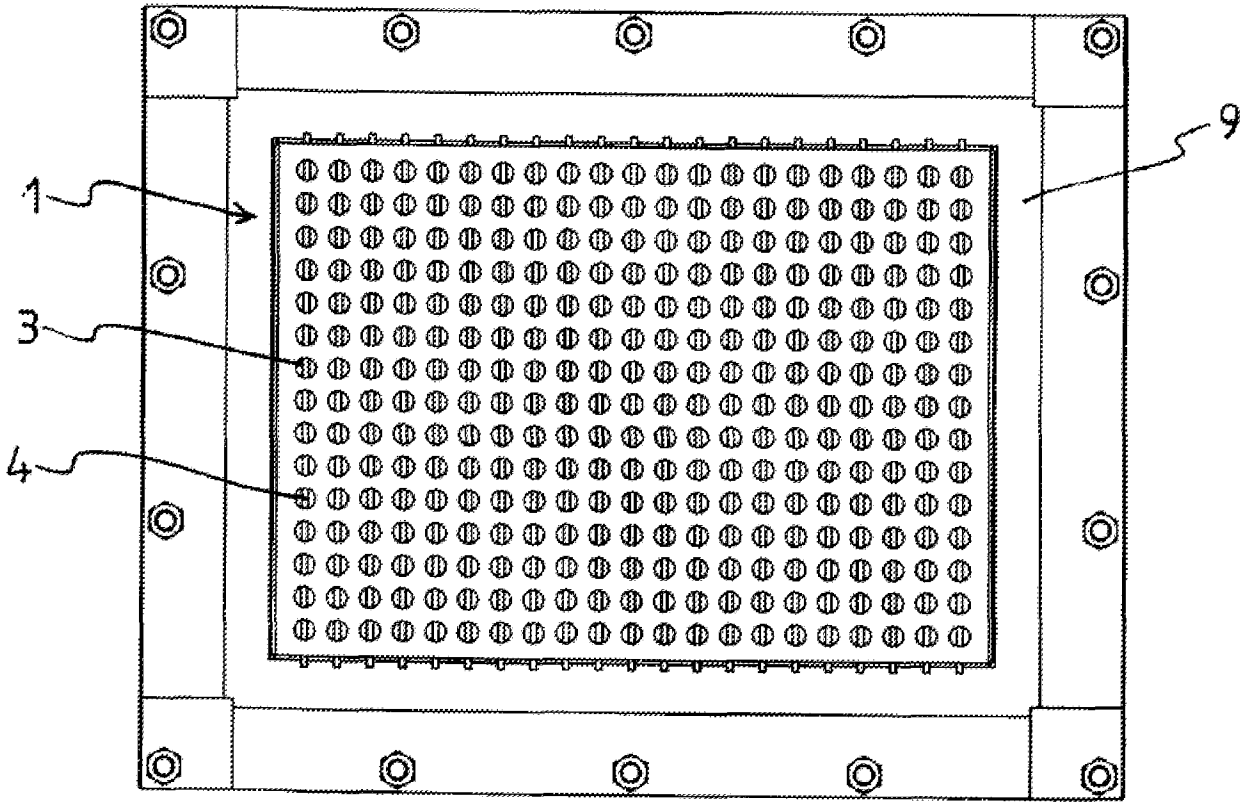
FIG. 2 shows a top view of the burner according to the invention according to FIG. 1.
Figure 3:
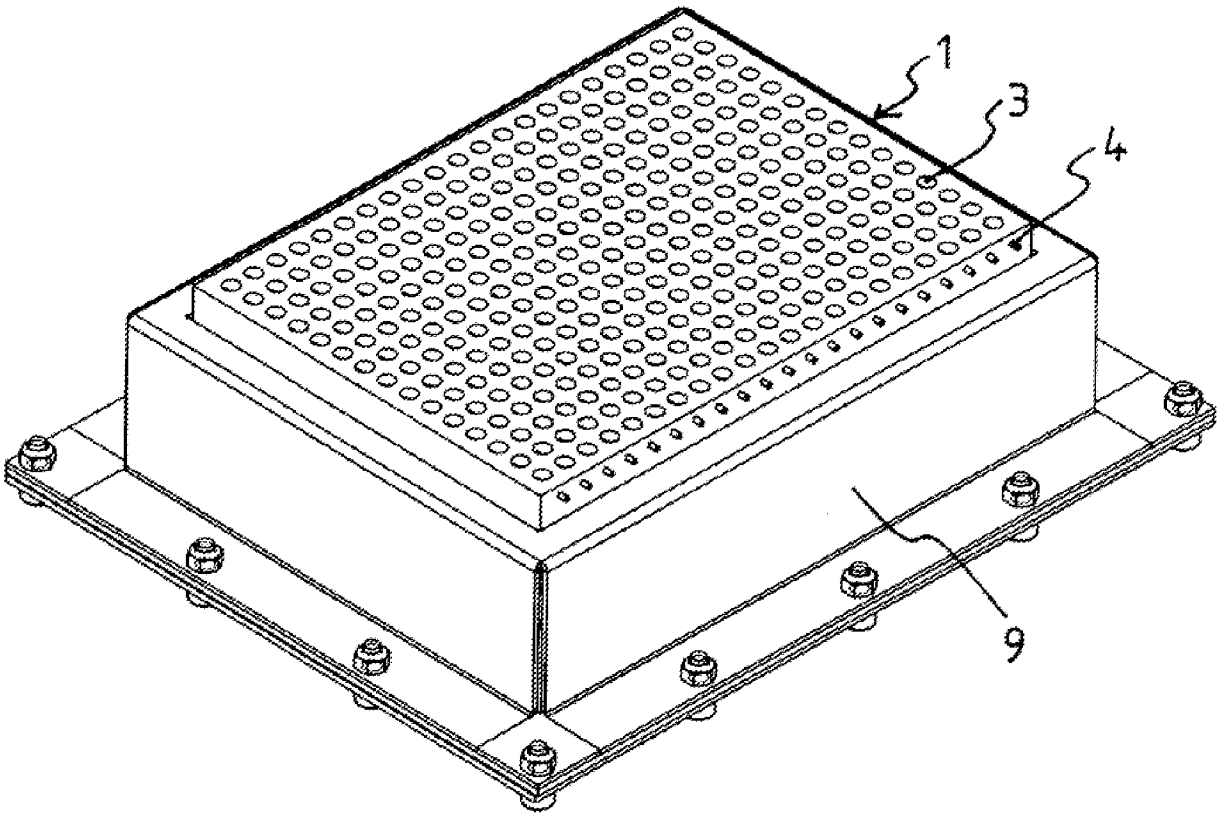
FIG. 3 shows a perspective view of the burner according to the invention according to FIG. 1 at an angle from above.

FIG. 2 shows a top view of the burner according to the invention according to FIG. 1, and FIG. 3 shows a perspective view of the burner according to the invention according to FIG. 1 at an angle from above, wherein identical parts are given identical reference numbers in all three figures.

LIST OF REFERENCE NUMBERS

1 burner plate
2 passage channels
3 combustion channels
4 flow obstacles
5 gas feed line
6 mixing chamber
7 perforated sheet
8 mounting base plate
9 fixing sheet

The invention claimed is:

1. Burner, in particular radiant burner, for the combustion of a gas mixture of fuel gas and an oxygen carrier gas, comprising:

a burner plate with passage channels for the throughflow of the gas mixture from a mixing chamber side to a combustion side, wherein, on the combustion side, combustion channels with an enlarged cross-section compared with the passage channels connect to the passage channels, wherein flow obstacles for a contact with the combustion flame are arranged in the combustion channels, and wherein the flow obstacles are made of a material which has a higher thermal conductivity than the material of the burner plate, wherein the flow obstacles extend transversely through the combustion channels, and wherein in each case a rod or wire extends through the combustion channels arranged adjacently in a row along the width of the burner plate or extends transversely through the burner plate.

2. Burner according to claim 1, wherein at least one point over their length the passage channels for the throughflow of the gas mixture have a maximum diameter which is smaller than a quenching distance of the combustion.

3. Burner according to claim 1, wherein at least sections of the combustion channels have a maximum diameter over their length which is greater than a quenching distance of the combustion.

4. Burner according to claim 1, wherein the passage channels and/or the combustion channels in the burner plate have an oval or circular cross-section.

5. Burner according to claim 1, wherein the cross-section at the transition zone between the passage channels and the combustion channels widens conically, stepwise or in a combination of both.

6. Burner according to claim 1, wherein the flow obstacles are made of metal or ceramic.

7. Burner according to claim 1, wherein the flow obstacles are formed as rods with round or polygonal cross-section or as a metal strip or as a perforated sheet.

8. Burner according to claim 1, wherein the burner plate is constructed from at least two plates arranged one above the other, and wherein a first plate, which is arranged towards the mixing chamber side during operation, has the passage channels, and a second plate, which is arranged towards the combustion side during operation, has the combustion channels.

9. Burner according to claim 8, wherein the first plate, which is arranged towards the mixing chamber side during operation, has a lower heat capacity and/or a lower thermal conductivity than the second plate, which is arranged towards the combustion side during operation.

10. Burner according to claim 1, wherein the burner plate is made of high-temperature-resistant ceramic fibrous material with low thermal conductivity.

11. Burner according to claim 10, wherein the ceramic fibrous material of which the burner plate is made contains:

40 to 90 wt.-% $Al_2O_3$ and 10 to 60 wt.-% $SiO_2$ or 60 to 85 wt.-% $SiO_2$ and 15 to 25 wt.-% (CaO+MgO).

* * * * *